US006945810B1

(12) United States Patent
Morana et al.

(10) Patent No.: US 6,945,810 B1
(45) Date of Patent: Sep. 20, 2005

(54) DOUBLE ENDED GUIDE PIN FOR KEYING ON BOTH SIDES OF A CIRCUIT BOARD

(75) Inventors: Francis P. Morana, Mechanicsburg, PA (US); David S. Szczesny, Hershey, PA (US); Nancy Reeser, Lemoyne, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/832,548

(22) Filed: Apr. 28, 2004

(51) Int. Cl.[7] ..... H01R 13/64

(52) U.S. Cl. ..... 439/378; 439/64; 439/680

(58) Field of Search ..... 439/377–379, 439/64, 680–681

(56) References Cited

U.S. PATENT DOCUMENTS

| | | | | | |
|---|---|---|---|---|---|
| 3,643,204 | A | * | 2/1972 | Drenten | 439/65 |
| 4,568,134 | A | | 2/1986 | DiMondi | |
| 4,776,811 | A | | 10/1988 | Humphrey | |
| 4,998,892 | A | | 3/1991 | Shiley | |
| 5,032,088 | A | * | 7/1991 | Kuramitsu | 439/378 |
| 5,125,849 | A | * | 6/1992 | Briggs et al. | 439/378 |
| 6,059,600 | A | * | 5/2000 | Vanbesien | 439/378 |

* cited by examiner

*Primary Examiner*—Truc Nguyen

(57) ABSTRACT

A double ended guide pin includes an elongated body having first and second opposite ends extending along a longitudinal axis of the body and an attachment portion centrally located between the first and second ends. Each of the first and second ends includes at least one keying surface and each of the first and second ends is receivable in a guide that has a channel corresponding to the at least one keying surface.

19 Claims, 4 Drawing Sheets

DOUBLE ENDED GUIDE PIN FOR KEYING ON BOTH SIDES OF A CIRCUIT BOARD

BACKGROUND OF THE INVENTION

The invention relates generally to circuit board connectors and, more particularly, to guide pins for mechanically interconnecting circuit boards.

Modern high speed communications systems, such as cellular communications base stations, for example, typically include a primary circuit board, sometimes referred to as a mother board, and one or more peripheral circuit boards, called daughter cards. Electrical connectors establish communication between the motherboard and the daughter cards, and typically include many pin contacts which are inserted through holes in the motherboard to establish electrical contact therewith. In order to conserve space on the circuit boards, it is common to mount mother boards and daughter cards at a right angle to each other. Typically, one or more guide pins are used to mechanically link the circuit boards together. The guide pins provide preliminary alignment or preliminary guidance between the circuit boards being interconnected.

In another technique for saving board space, a feed-through type connector is used to mount components to both sides of the circuit board. The feed-through connector may include an array of male pins that extend through the circuit board with a shroud on each side forming a double ended connector. In a feed-through connection, alignment of the components must be addressed on both sides of the circuit board.

In a high speed application, such as a communications base station, some system components can be relatively large. For instance, daughter cards may be as much as three feet wide with a mating edge that is three feet long. The motherboard, typically, is stored in a cabinet or rack in a mainframe room or equipment room. In some installations, the daughter cards are mounted on tracks and are slid toward the motherboard perpendicular to the motherboard.

In such applications, guide pins are needed that provide the capability to overcome the bulk of the circuit boards and maintain the boards sufficiently aligned to provide for satisfactory mating of the electrical connectors between the circuit boards.

BRIEF DESCRIPTION OF THE INVENTION

In an exemplary embodiment of the invention, a double ended guide pin is provided that includes an elongated body having first and second opposite ends extending along a longitudinal axis of the body and an attachment portion centrally located between the first and second ends. Each of the first and second ends includes at least one keying surface and each of the first and second ends is receivable in a guide that has a channel corresponding to the at least one keying surface.

Optionally, the guide pin attachment portion includes a substantially cylindrical center flange having a lower surface that engages a surface of a circuit board, a locating ring adjacent the flange lower surface, and a retaining portion configured to receive a fastener to secure the body to the circuit board. The locating ring includes a guide pin key located on a perimeter thereof. The guide pin key is received in a slot in the circuit board to orient the body relative to the circuit board. The locating ring also includes at least one centering rib located on a perimeter thereof, to center the body in a mounting hole in the circuit board. The keying surfaces on the first and second ends are flat and have a predetermined width between longitudinal edges of the corresponding first and second ends.

In an alternative embodiment, a double ended guide pin for mounting components to opposite sides of a circuit board is provided that includes an elongated body having first and second opposite ends and an attachment portion therebetween. The first and second ends and the attachment portion extend along a longitudinal axis of the body. A first keying member is located on the first end, a second keying member is located on the second end, and a third keying member is located on the attachment portion. Each of the first and second keying members has a separately predetermined angular orientation with respect to the third keying member. Each of the first and second ends is receivable in a guide having a channel that is correspondingly keyed and correspondingly oriented with respect to the third keying member.

DETAILED DESCRIPTION OF THE INVENTION

Figure 1:
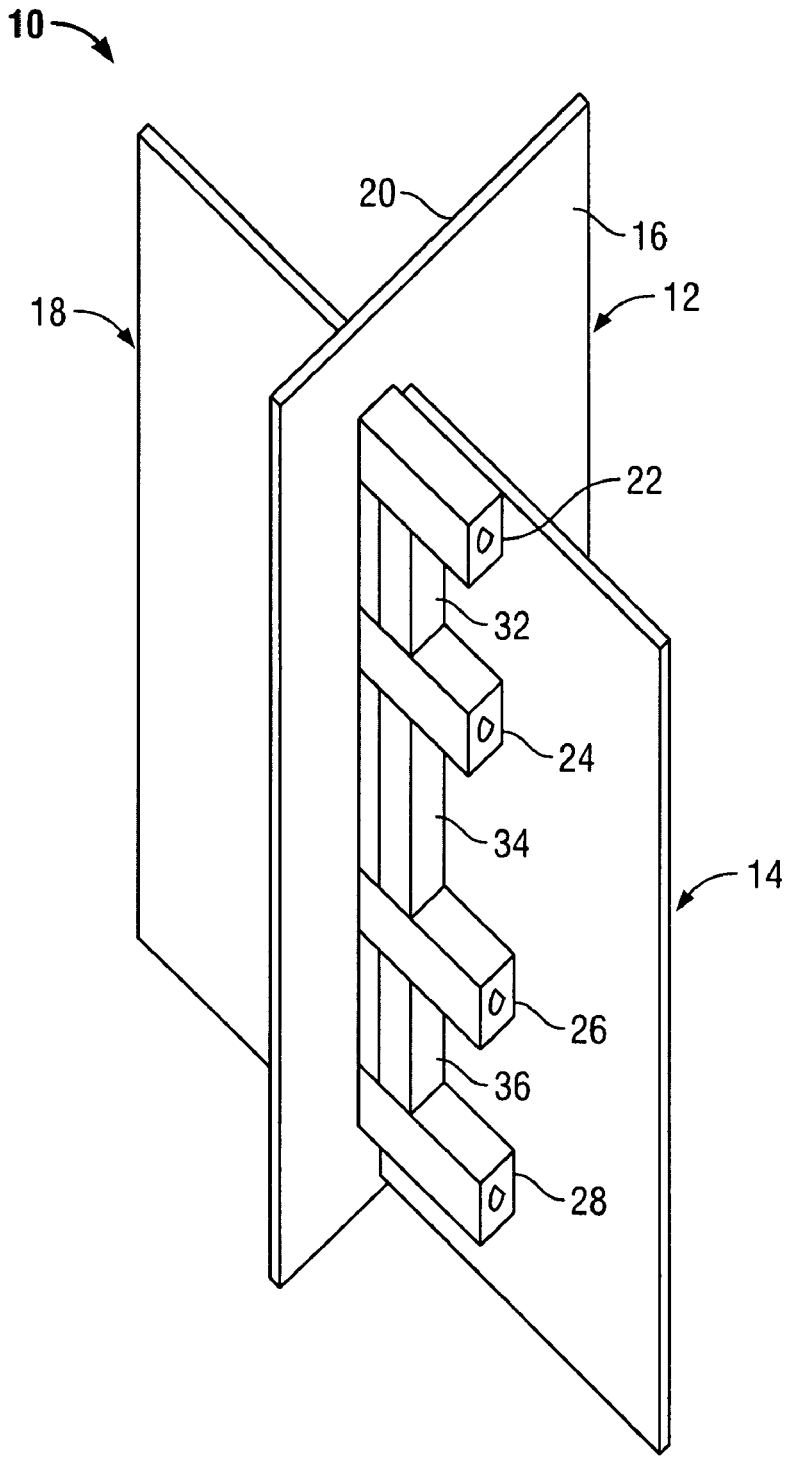
FIG. 1 is a perspective view of a circuit board assembly in accordance with an embodiment of the present invention.

FIG. 1 illustrates a circuit board assembly 10 formed in accordance with an exemplary embodiment of the present invention. The assembly 10 includes a motherboard 12, a first daughter card, or daughter board 14, connected to a first side 16 of the motherboard 12 and a second daughter card 18 connected to a second side 20 of the motherboard 12.

The first daughter card 14 includes guide modules 22, 24, 26, and 28 which mechanically connect the first daughter card 14 to the motherboard 12. The first daughter card 14 also includes surface mounted electrical connectors 32, 34, and 36 that also mechanically connect the first daughter card 14 to the motherboard 12 and may also electrically connect the first daughter card 14 to the motherboard 12 and/or the second daughter card 18.

While the invention is herein described in the context two daughter cards connected to a motherboard to form a circuit board assembly, it is to be understood that other assemblies are contemplated between circuit boards or other components wherein the benefits of the invention may be appreciated. In particular, no limitation is intended in the particular arrangement or number of the guide pins used in the assembly or in the number, type, or arrangement of the electrical connectors described herein.

Figure 2:
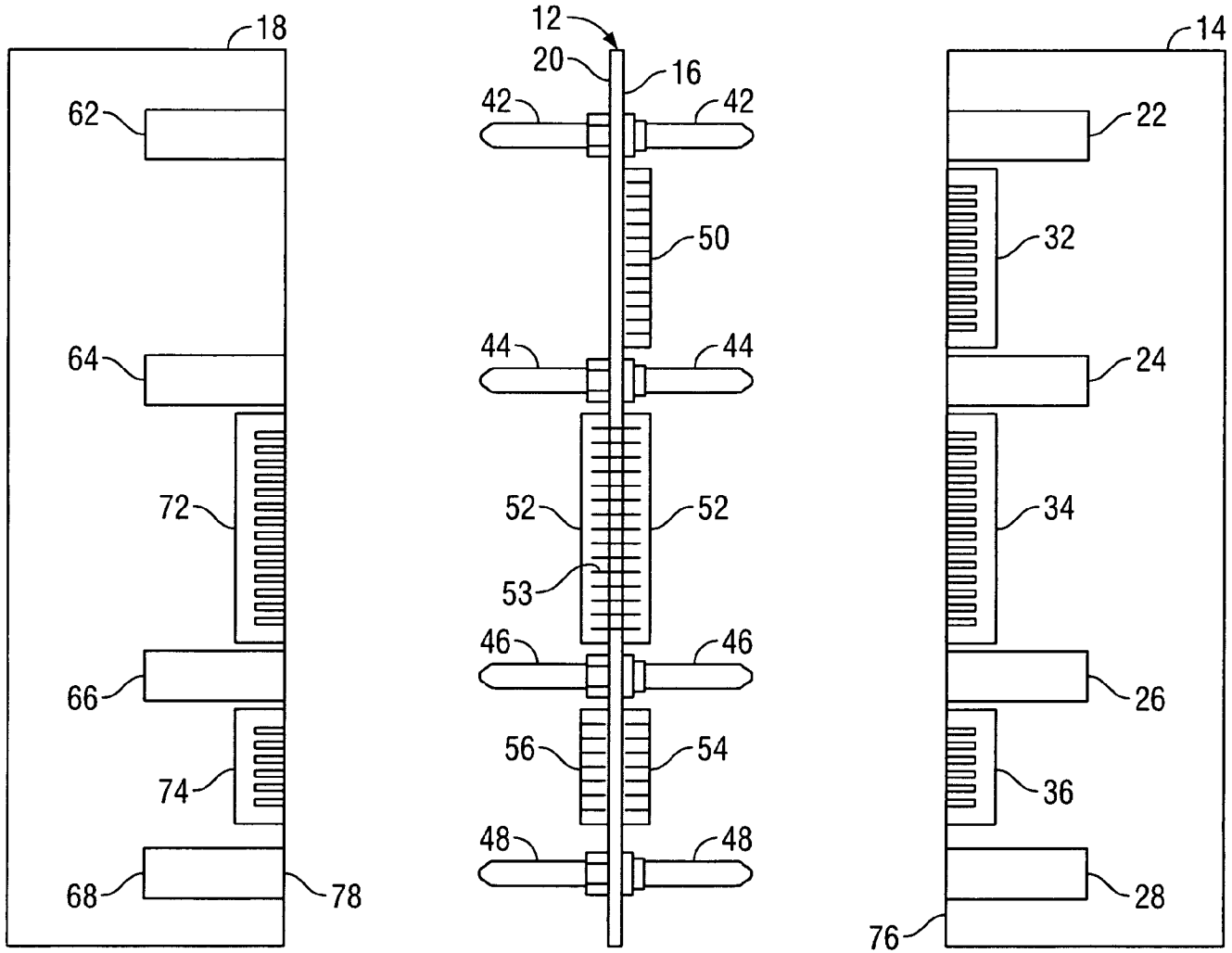
FIG. 2 is a side view of the assembly of FIG. 1 with the daughter boards separated from the motherboard.

FIG. 2 illustrates a side view of the circuit board assembly 10 with the first and second daughter cards 14 and 18 separated from the motherboard 12. The motherboard 12 includes four double ended guide pins 42, 44, 46, and 48. Electrical connectors 50, 52, and 54 are interspersed between the guide pins 42, 44, 46, and 48. The connector 50 is mounted on the first side 16 of the motherboard 12 and is a mating connector to the connector 32 on the first daughter card 14 and electrically connects circuits on the first daughter card 14 with circuits on the motherboard 12. The connector 52 is a feed-through connector that electrically connects circuits on the first daughter card 14 to circuits on the second daughter card 18. The feed-through connector 52 typically includes a set of male pins 53 that extend through a circuit board, in this case, the motherboard 12, with a shroud (not shown) on each side. In other words, the feed-through connector 52 is a double ended shrouded male connector. The feed-through connector 52 mates with the connector 34 on the first daughter card 14. The motherboard 12 also includes a connector 54 that is mounted on the first side 16 of the motherboard 12 and is a mating connector to the connector 36 on the first daughter card 14. The connector 54 electrically connects circuits on the motherboard 12 with circuits on the first daughter card 14. The mother board 12 also includes a connector 56 that is mounted on the second side 20 of the motherboard 12 and electrically connect circuits on the motherboard 12 with circuits on the second daughter card 18.

The second daughter card 18 connects to the second side 20 of the motherboard 12. The second daughter card 18 includes guide modules 62, 64, 66, and 68 that receive an end of the guide pins 42, 44, 46, and 48 respectively when the second daughter card 18 is connected to the motherboard 12. The second daughter card 18 includes a connector 72 that mates with the feed-through connector 52 to electrically connect circuits on the second daughter card 18 with circuits on the first daughter card 14 as previously described. A second electrical connector 74 is mounted on the second daughter card 18 that mates with the connector 56 that is mounted on the second side 20 of the motherboard 12. The connector 74 electrically connects circuits on the second daughter card 18 with circuits on the motherboard 12.

The guide pins 42, 44, 46, and 48 are double ended guide pins that can be used to mount components, or circuit boards, such as first and second daughter cards 14 and 18, respectively to opposite sides of another circuit board, such as the motherboard 12. The guide pins 42, 44, 46, and 48 carry a load, or weight of the first and second daughter cards 14 and 18, respectively and also provide a preliminary guidance or alignment for the mating electrical connectors, 50 and 32, 52 and 34, 54 and 36, and also 52 and 72, and 56 and 74.

Though depicted and described with one pair of first and second daughter cards 14 and 18 connected to motherboard 12, it is to be understood that in other embodiments, fewer or more daughter cards and/or daughter card pairs, such as daughter cards 14 and 18, may be connected to the motherboard 12 depending on the size of the motherboard 12.

In an exemplary embodiment, the assembly 10 is part of a high speed multi-gig application such as is used in cellular communications base stations. In such applications, a mating edge 76 of the first daughter card 14 may be three feet long or thereabouts. Similarly, the second daughter card 18 can have a mating edge 78 that also measures in the neighborhood of about three feet long. The mother board 12 would be similarly scaled and mounted in a rack (not shown). Each of the first and second daughter cards 14 and 18 could weigh as much as of one hundred pounds or more depending on how populated the particular board, or card, is. The guide pins 42, 44, 46, and 48 are sized to be able to carry the gravitational loads imposed by the first and second daughter cards 14 and 18. Typically, with the size that some of these circuit boards, or daughter cards, can attain, some amount of "bowing" or curving of the boards will occur during the mating process. The guide pins 42, 44, 46, and 48 are also designed to be able to "pull in" or sufficiently remove the bowing so that mating of the electrical connectors can take place.

Figure 3:
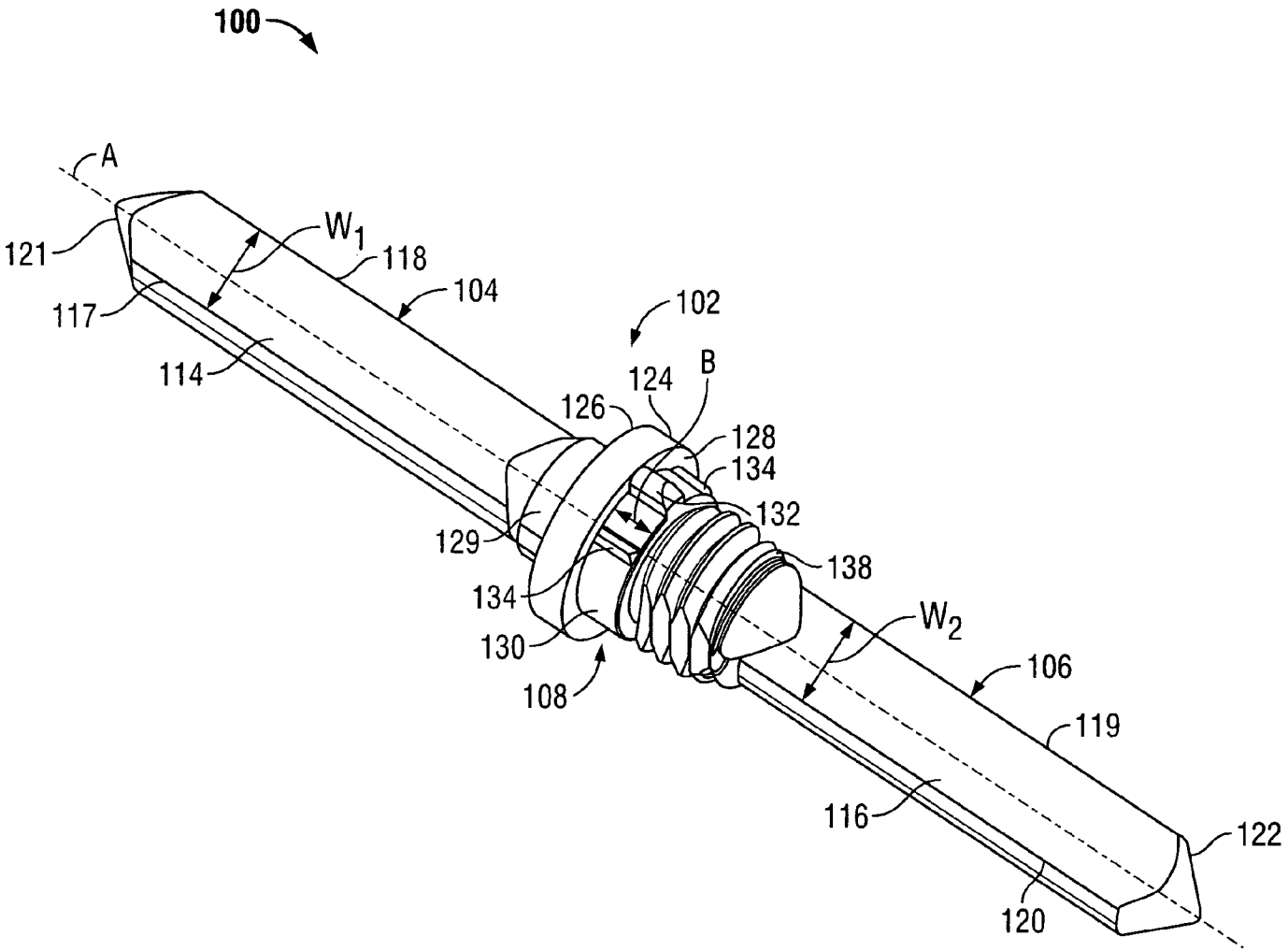
FIG. 3 is a perspective view of an exemplary guide pin formed in accordance with an embodiment of the present invention.

FIG. 3 illustrates an exemplary guide pin 100 that may be used in the circuit board assembly 10. The guide pin 100 is a double ended guide pin that can be used for mounting components or daughter cards, such as first and second daughter cards 14 and 18 (shown in FIGS. 1 and 2) to opposite sides of a circuit board, such as motherboard 12 (shown in FIGS. 1 and 2). The guide pin 100 includes an elongated body 102 that extends along a longitudinal axis A. The body 102 includes a first end 104 and a second opposite end 106 that both extend along the longitudinal axis A, and an attachment portion 108 that is centrally located between the first and second ends 104 and 106 respectively.

When attached to the circuit board, the guide pin first and second ends 104 and 106 respectively, extend from opposite sides of the circuit board (see FIG. 2). The first end 104 includes a keying surface 114 that matches a corresponding surface in a guide module (not shown in FIG. 3) that is attached to a mating component or circuit board such as a daughter card 14 or daughter card 18. The second end 106 has a similar keying surface 116 that is likewise received in a guide module (not shown) designed with a corresponding surface. The keying surface 114 is substantially flat and has a predetermined width $W_1$ measured between lateral edges 117 and 118 of the guide pin first end 104. The keying surface 116 is also substantially flat and has a predetermined width $W_2$ measured between lateral edges 119 and 120 of the guide pin second end 106. Each end 104 and 106 also includes a rounded and tapered tip, 121 and 122, respectively. It should be noted that although only one keying surface 114, 116 is shown on each end 104 and 106 of the guide pin 100 in the view of FIG. 3, it is contemplated that in other embodiments, the ends 104 and 106 may include multiple keying surfaces. Further, the keying surfaces need not be flat, but rather, other contours or combinations of contours are also contemplated.

The attachment portion 108 is provided to attach the guide pin 100 to a circuit board, such as the mother board 12. The attachment portion 108 includes a center flange 124 that is substantially cylindrical and has an upper surface 126 and a lower surface 128. The lower surface 128 rests on an upper surface of the circuit board in which the guide pin 100 is installed, such as the first side 16 of the motherboard 12 (as shown in FIG. 1). The guide pin 100 is formed with a shoulder 129 adjacent the upper surface 126 of the center flange 124. The shoulder 129 is provided to strengthen the guide pin 100. A locating ring 130 is adjacent the lower surface 128. A guide pin key 132 and one or more centering ribs 134 are formed on a perimeter of the locating ring 130. The guide pin key 132 is received in a slot (shown in FIG. 4) in the circuit board in which the guide pin 100 is installed. The centering ribs 134 bite into the circuit board material to both center the guide pin 100 in the circuit board attachment hole and resist movement of the guide pin key 132 in the slot in the circuit board. In an exemplary embodiment, the locating ring 130 includes three centering ribs 134 spaced one hundred twenty degrees apart around the perimeter of the locating ring 130. In other embodiments, fewer or more centering ribs 134 may be provided.

A retaining portion 138 extends downwardly from the locating ring 130. The retaining portion 138 is provided to secure the guide pin 100 to the circuit board. In an exemplary embodiment, the retaining portion 138 is threaded to receive a threaded fastener such as a hex nut (not shown).

Figure 4:
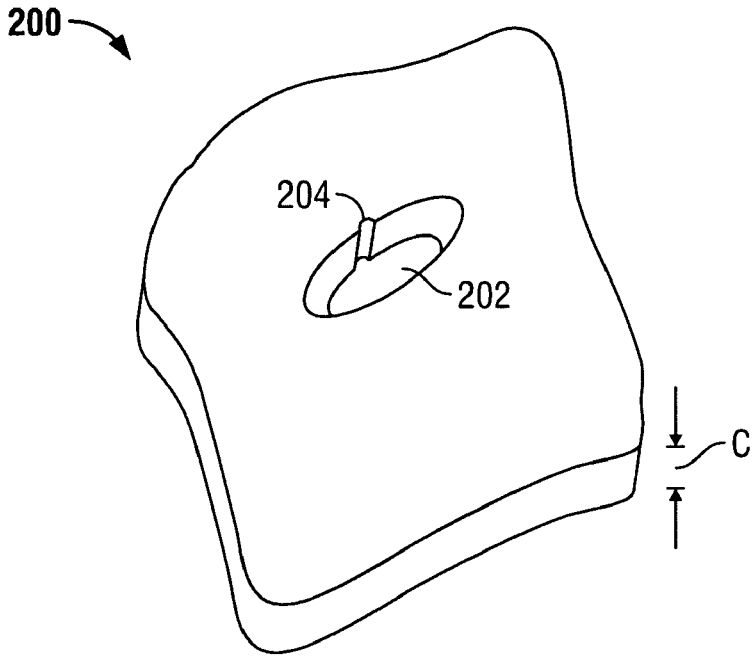
FIG. 4 is a perspective view of a portion of a circuit board having a mounting hole for a guide pin formed in accordance with an embodiment of the present invention.

FIG. 4 illustrates a partial perspective view of a circuit board 200 that includes a guide pin mounting hole 202 in which the guide pin 100 (shown in FIG. 3) may be mounted. The mounting hole 202 includes a slot 204 that receives the guide pin key 132. The guide pin locating ring 130 has an axial length B that is substantially equal to a thickness C of the circuit board 200.

Figure 5:
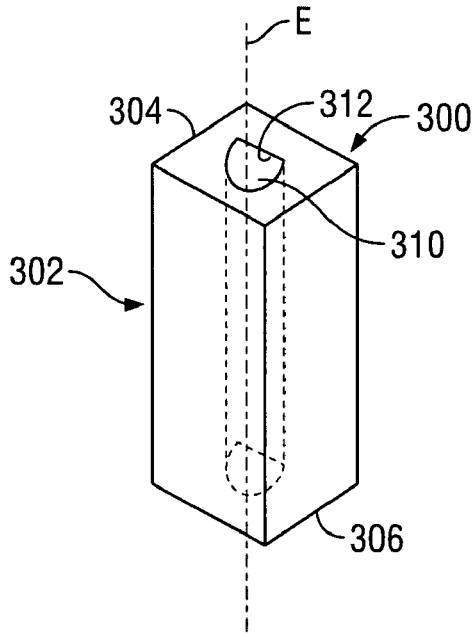
FIG. 5 is a perspective view of a guide module for a guide pin formed in accordance with an embodiment of the present invention.

FIG. 5 illustrates a perspective view of an exemplary guide module 300 that can be used with the guide pin 100. The guide module 300 includes an elongate body 302 that extends between an upper end 304 and a lower end 306. A guide pin channel 310 extends through the body 302 along a longitudinal axis E. The guide pin channel 310 is formed with at least one complementary keying surface 312 that corresponds with the keying surface provided on the guide pin 100 with which it is intended to be used.

Use of the guide pin 100 will be described with reference to FIGS. 1–5. With the keying surfaces 114 and 116 (FIG. 3) on the guide pin 100, and 312 on the guide receptacle (FIG. 5), it should be apparent that the guide pins 100 and guide modules 300 are used in matched sets. The guide modules 300 are positioned and attached to the mating circuit boards, such as daughter cards 14 and 18 (FIG. 1), and the guide pin locations on the circuit board 200 are determined. Prior to installing the guide pin 100 on the circuit board 200, a slot 204 is formed in the guide pin mounting hole 202 to orient the guide pin keying surfaces 114 and 116 (FIG. 3) with respect to the circuit board 200 and with respect to the guide module positioning on the daughter cards 14, and 18. The guide pin 100 is then installed and a fastener provided (not shown) to secure the guide pin 100 in position on the circuit board 200. The centering ribs 134 (FIG. 3) bite into the circuit board material to center the guide pin 100 and further inhibit any shifting in the position of the guide pin 100. The keying arrangement between the guide pin 100 and the guide module 300 prevents a technician from mounting a circuit board in an incorrect location such that the risk of damage to connectors or the electrical circuits on the circuit boards is reduced. In addition, the double ended aspect of the guide pin 100 provides for alignment of circuit boards, such as daughter cards 14 and 18, with respect to each other on opposite sides of a circuit board, such as motherboard 12, that is particularly useful with regard to the use of feed-through connector applications.

It is to be understood that the mounting arrangement of the assembly components are best planned for connections on both sides of the circuit board, or motherboard 12 (FIGS. 1 and 2). The guide pin 100 may be formed with many different keying schemes. With reference to FIG. 3, the guide pin 100 includes a first keying member, in the form of the keying surface 114 on the first end 104, a second keying member, that is, keying surface 116, on the second end 106, and a third keying member, the guide pin key 132, on the guide pin attachment portion 108. The keying surfaces 114 and 116 can be separately oriented with respect to the guide pin key 132 to form one of several possible keying arrangements.

The embodiments thus described provide a double ended guide pin that is suitable for connecting components, such as daughter cards, to both sides of a circuit board, such as a motherboard, and is particularly useful in multi-gig, high speed environments. Each end of the guide pin has keying surfaces and is received in similarly keyed guide modules attached to the connecting daughter card. The guide pin itself is also keyed to the motherboard. The guide pin provides preliminary alignment for the electrical connection between the circuit boards. The keying arrangement can be varied to provide assurance that a daughter card is being connected to the correct location on the motherboard so that the possibility of damage to the connectors or circuits resulting from incorrect connections is minimized.

While the invention has been described in terms of various specific embodiments, those skilled in the art will recognize that the invention can be practiced with modification within the spirit and scope of the claims.

What is claimed is:

1. A double ended guide pin for mounting components to opposite sides of a circuit board, said guide pin comprising:

an elongated body having first and second opposite ends extending along a longitudinal axis of said body and an attachment portion centrally located between said first and second ends, each said first and second end including at least one keying surface, each said first and second end receivable in a guide having a channel corresponding to said at least one keying surface; and a locating ring on said attachment portion, said locating ring including at least one centering rib located on a perimeter thereof to center said body in a mounting hole in the circuit board.

2. The guide pin of claim 1, wherein said attachment portion comprises:

a substantially cylindrical center flange having a lower surface that engages a surface of the circuit board;

a locating ring adjacent said flange lower surface to orient said body relative to the circuit board; and a retaining portion configured to receive a fastener to secure said body to the circuit board.

3. The guide pin of claim 1, wherein each said first and second end includes a tapered tip.

4. The guide pin of claim 1, wherein said attachment portion includes a locating ring that includes a guide pin key located on a perimeter thereof, said guide pin key received in a slot in the circuit board to orient said body relative to the circuit board.

5. The guide pin of claim 1, wherein said keying surfaces on said first and second ends are flat.

6. The guide pin of claim 1, wherein said keying surfaces on said first and second ends are flat, said keying surfaces each having a predetermined width between longitudinal edges of said corresponding first and second ends.

7. The guide pin of claim 1, wherein said attachment portion includes a substantially cylindrical center flange and a shoulder adjacent an upper surface of said flange, to strengthen the guide pin.

8. The guide pin of claim 1, wherein said attachment portion includes a locating ring that has an axial length that is approximately equal to a thickness of the circuit board.

9. The guide pin of claim 1, wherein said attachment portion includes a retaining portion that is threaded to receive a fastener.

10. A double ended guide pin for mounting components to opposite sides of a circuit board, said guide pin comprising:

an elongated body having first and second opposite ends and an attachment portion therebetween, said first and second ends and said attachment portion extending along a longitudinal axis of said body;

a first keying member located on said first end;

a second keying member located on said second end; and a third keying member located on said attachment portion, each said first and second keying members having a separately predetermined angular orientation with respect to said third keying member, each said first and second end receivable in a guide having a channel correspondingly keyed and correspondingly oriented with respect to said third keying member.

11. The guide pin of claim 10, wherein said first keying member comprises at least one keying surface.

12. The guide pin of claim 10, wherein said second keying member comprises at least one keying surface.

13. The guide pin of claim 10, wherein said attachment portion includes a locating ring, said third keying member comprising a guide pin key located on a perimeter of said locating ring, said guide pin key received in a slot on the circuit board to orient the body relative to the circuit board.

14. The guide pin of claim 10, wherein said first and second keying members each comprise at least one flat surface formed on said first and second ends, each of said at least one flat surface having a predetermined width between longitudinal edges of said first and second ends.

15. The guide pin of claim 10, wherein said attachment portion comprises:

a substantially cylindrical center flange having a lower surface that engages a surface of the circuit board;

a locating ring adjacent said flange lower surface to orient said body relative to the circuit board; and a retaining portion configured to receive a fastener to secure said body to the circuit board.

16. The guide pin of claim 10, wherein said attachment portion includes a locating ring that includes at least one centering rib located on a perimeter thereof to center said body in a mounting hole in the circuit board.

17. The guide pin of claim 10, wherein said attachment portion includes a substantially cylindrical center flange and a shoulder adjacent an upper surface of said flange, to strengthen the guide pin.

18. The guide pin of claim 10, wherein said attachment portion includes a locating ring that has an axial length that is approximately equal to a thickness of the circuit board.

19. The guide pin of claim 10, wherein said attachment portion includes a retaining portion that is threaded to receive a fastener.

* * * * *